US009586232B2

(12) United States Patent
Thompson et al.

(10) Patent No.: US 9,586,232 B2
(45) Date of Patent: Mar. 7, 2017

(54) METHOD FOR APPLYING A POWDER COATING

(71) Applicant: AKZO NOBEL COATINGS INTERNATIONAL B.V., Arnhem (NL)

(72) Inventors: Steven Thomas Thompson, Tyne & Wear (GB); Robert Edward Barker, Tyne & Wear (GB); Neil Lewis Engward, Tyne & Wear (GB); Gavin John Scott, Tyne & Wear (GB)

(73) Assignee: Akzo Nobel Coatings International B.V., Arnhem (NL)

( * ) Notice: Subject to any disclaimer, the term of this patent is extended or adjusted under 35 U.S.C. 154(b) by 134 days.

(21) Appl. No.: 14/386,512

(22) PCT Filed: Mar. 26, 2013

(86) PCT No.: PCT/EP2013/056369

§ 371 (c)(1),
(2) Date: Sep. 19, 2014

(87) PCT Pub. No.: WO2013/144127

PCT Pub. Date: Oct. 3, 2013

(65) Prior Publication Data

US 2015/0037508 A1 Feb. 5, 2015

Related U.S. Application Data

(60) Provisional application No. 61/639,188, filed on Apr. 27, 2012.

(30) Foreign Application Priority Data

Mar. 28, 2012 (EP) ..... 12161770

(51) Int. Cl.
*B05D 3/02* (2006.01)
*B05D 7/00* (2006.01)
(Continued)

(52) U.S. Cl.
CPC ..... *B05D 7/542* (2013.01); *B05D 1/06* (2013.01); *B05D 1/36* (2013.01); *B05D 3/0254* (2013.01);
(Continued)

(58) Field of Classification Search
None
See application file for complete search history.

(56) References Cited

U.S. PATENT DOCUMENTS 5,560,753 A * 10/1996 Schnabel ..... B24D 3/344 428/141
6,120,832 A * 9/2000 Walsh ..... B05B 12/124 118/624
(Continued)

FOREIGN PATENT DOCUMENTS

EP 0 994 141 4/2000
EP 1 547 698 6/2005
(Continued)

OTHER PUBLICATIONS

Probst et al., "Structure and electrical properties of carbon black", Carbon vol. 40 (2002), pp. 201-205.*
International Search Report for Application No. PCT/EP2013/05369, mailed on Jun. 27, 2013.
European Search Report for EP Application No. 12161770.8, dated Aug. 1, 2012.
(Continued)

*Primary Examiner* — Shamim Ahmed
*Assistant Examiner* — Bradford Gates
(74) *Attorney, Agent, or Firm* — McDonnell Boehnen Hulbert & Burghoff LLP

(57) ABSTRACT

A method for the application of at least two different powder coating layers to a substrate comprising the steps of application of a first powder coating layer followed by the application of a second powder coating layer, without any substantial curing of the first powder coating layer prior to the application of the second powder coating layer, followed by the simultaneous curing of the first powder coating layer
(Continued)

and the second powder coating layer, wherein the first powder coating layer or the second powder coating layer comprises 1 to 10 weight % of a conductive component having a resistivity of below 5 Ωcm at a packing volume of ≤70%.

20 Claims, 1 Drawing Sheet

(51) Int. Cl.
*B05D 1/06* (2006.01)
*B05D 1/36* (2006.01)

(52) U.S. Cl.
CPC ..... *B05D 2451/00* (2013.01); *B05D 2601/20* (2013.01)

(56) References Cited

U.S. PATENT DOCUMENTS

| | | | | |
|---|---|---|---|---|
| 6,342,144 | B1 * | 1/2002 | December | B05D 1/36 204/484 |
| 2004/0159282 | A1 | 8/2004 | Sanner et al. | |
| 2006/0110601 | A1 | 5/2006 | Hennessey | |

FOREIGN PATENT DOCUMENTS

| | | |
|---|---|---|
| EP | 2 060 328 | 5/2009 |
| WO | 97/05965 | 2/1997 |
| WO | 2005/018832 | 3/2005 |
| WO | 2008/088605 | 7/2008 |
| WO | 2011/134986 | 11/2011 |

* cited by examiner

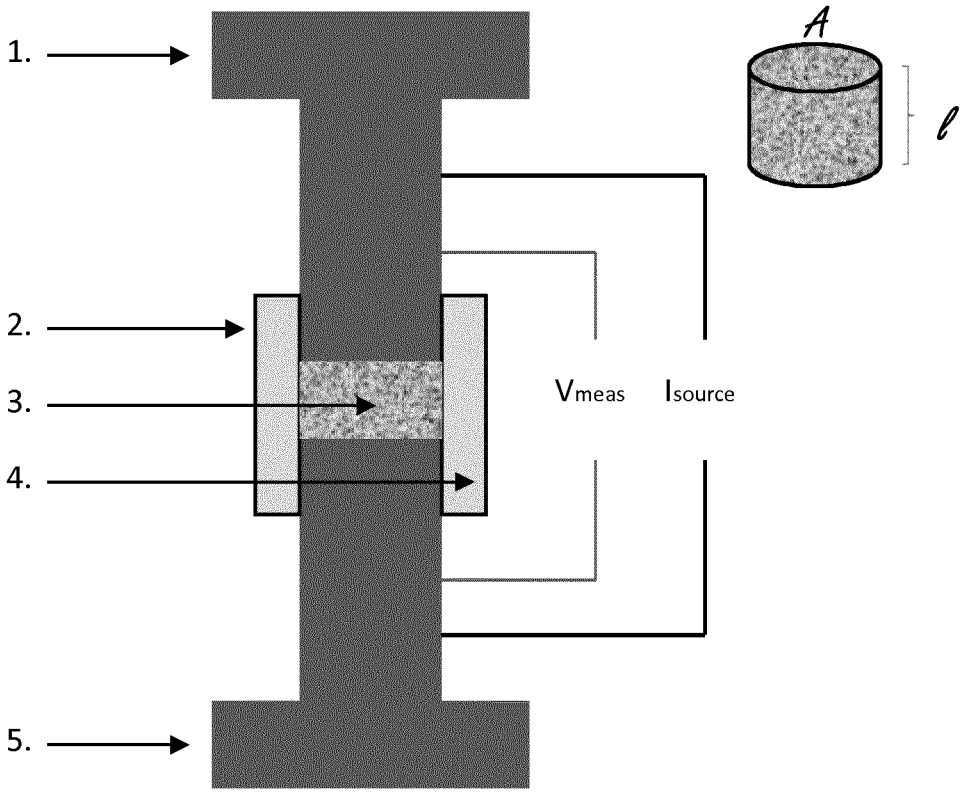
1.
2.
3.
4.
5.
Vmeas
Isource
A
ℓ

METHOD FOR APPLYING A POWDER COATING

REFERENCE TO RELATED APPLICATIONS

This application is the U.S. National Phase of PCT/EP2013/056369, filed on Mar. 26, 2013, and claims the benefit of EP Application No. 12161770.8, filed on Mar. 28, 2012, and U.S. Provisional Application No. 61/639,188, filed on Apr. 27, 2012.

BACKGROUND OF THE INVENTION

Field of the Invention

Powder coatings are solid compositions which are generally applied by an electrostatic spray process in which the powder coating particles are electrostatically charged by the spray gun and the substrate is earthed. Alternative application methods include fluidised-bed and electrostatic fluidised-bed processes. After application, the powder is heated to melt and fuse the particles and to cure the coating.

The compositions generally comprise a solid film-forming resin, usually with one or more colouring agents such as pigments, and optionally they also contain one or more performance additives. They are usually thermosetting, incorporating, for example, a film-forming polymer and a corresponding crosslinking agent (which may itself be another film-forming polymer). Generally, the resins have a Tg, softening point or melting point above 30° C.

The compositions are generally prepared by mixing ingredients, e.g. in an extruder, at a temperature above the softening temperature of the resin but below the curing temperature. The composition is then cooled to solidify it and is subsequently pulverised. The particle size distribution required for most commercial electrostatic spray apparatus is up to a maximum of 120 microns, with a mean particle size within the range of 15 to 75 microns, preferably 25 to 50 microns, more especially 20 to 45 microns.

The present invention relates to a method for applying a powder coating to a substrate, more in particular to a process for applying at least two powder coating layers to a substrate without any substantial curing of the first layer prior to the application of the second or further layers. This process is sometimes referred to as a dry-on-dry application process.

Prior Art

In WO 97/05965 a method is disclosed for simulating wood or marble in a finish by coating metal surfaces with a first layer of a colored powder coating layer, heating this layer to get a partial cure of this first layer (sometimes referred to as green cure), and thereafter applying a second colored powder coating layer, and subsequent heating of both layers to obtain a full cure of both layers.

In EP 1547698 a method is disclosed which is similar to the process in WO 97/05965, albeit that in the process of EP 1547698 the heating step after the application of the first powder coating layer is absent.

In WO 2008/088605 a method is disclosed for painting a substrate wherein in a first step a powder primer is applied to the substrate, in a next step a powder basecoat comprising a flake additive is applied onto the primer, the powder primer and powder basecoat are simultaneously cured and thereafter a topcoat is applied onto the powder basecoat and in a last step this topcoat is cured. It was found that this method only works at very specific conditions and control of certain parameters, such as layer thickness, charging of the powder particles, and settings of the application equipment.

In EP994141 a method is disclosed which is similar to the process in WO 2008/088605. In some of the examples carbon black is added in small amount (<1 wt. %) to the primer coating layer. However, it was found that in a process where the powder basecoat and powder topcoat are simultaneously cured, this only works at very specific conditions and control of certain parameters, such as layer thickness, charging of the powder particles, and settings of the application equipment.

In US 20060110601 a process for the application of a flouropolymer primer and overcoat is disclosed that uses a process similar to the process in WO 2008/088605. It is said that metal flake and carbon black can be added as filler. It is advised that the powder primer coating should contain 10 to 20 wt. % of such filler.

In EP 2060328 a method for forming a composite powder coating is disclosed wherein multiple layers of a powder coating are deposited on a substrate, wherein adjacent layers are formed of different types of powder coating compositions and wherein the multiple layers of the powder coating composition are cured in a single thermal step.

In WO 2005/018832 a method for coating substrates is disclosed wherein an image coat is applied over a background coating. Both image coating and background coating can be powder coatings. It is not necessary to partially cure the background coating before the image coat is applied. In this process the polarity of the background/base coat and the image coat must be the same.

In US 2004/0159282 a respray or repair coating method using powder coatings is disclosed where the respray or repair coating may be performed before or after the cure of the initial layer. The initial coating layer and the repair/respray coating layer should have the same electrostatic polarity.

So far, there has been little commercial success for systems based on any of the above processes for the dry-on-dry application of at least two powder coating layers. Main reasons for this are surface defects in the top powder layer which, when cured lead to an unsatisfactory appearance with evidence of mixing of the two layers. These surface defects can be masked by using a matt or dull colored coating for the top powder layer. However, the surface defects are clearly visible when a high gloss topcoat is used.

SUMMARY OF THE INVENTION

Accordingly, in one embodiment the present invention comprises a method for the application of at least two different powder coating layers to a substrate comprising the steps of application of a first powder coating layer followed by the application of a second powder coating layer, without any substantial curing of the first powder coating layer prior to the application of the second powder coating layer, followed by the simultaneous curing of the first powder coating layer and the second powder coating layer, wherein the first powder coating layer comprises a conductive component.

In another embodiment of the present invention, the second powder coating layer comprises a conductive component.

Within the framework of the present invention, a conductive component is a component that has a resistivity of below 1 Ωcm at a packing volume of ≤70%.

The resistivity of a component that is used in a powder coating composition can be measured by placing a certain amount of the component between two conductive elements, and measuring the resistance between the two conductive elements. An example of an apparatus that can be used for this measurement is displayed in FIG. 1.

1. is the upper conductive element having a circular shape;

2. is the left side of a glass ring;

3. is the sample of the conductive component to be measured;

4. is the right side of the glass ring;

5. is the lower conductive element having a circular shape;

The glass ring (or a ring of a non-conductive material) should enclose the lower part of the upper conductive element, the sample of the conductive component, and the upper part of the lower conductive element.

A sample of the conductive component is placed in between the upper and lower conductive element (the upper and lower conductive element are normally metal elements) and is further enclosed by the glass ring. If the conductive elements and the glass ring have a circular shape, the sample will have a shape with a surface area A where the sample is in contact with the upper or lower conductive element and a length l, where the sample is in contact with the glass ring.

To conduct a measurement, a certain amount ($W_s$ in g) of the sample is weighed and put between the conductive elements 1 and 5. A current ($I_{source}$) is applied to the conductive element and potential $V_{meas}$ is measured.

The resistivity of the sample can now be calculated as:

$$\text{Resistivity } (\Omega\text{cm}) = \frac{Vmeas}{Isource} \times \frac{A}{l}$$

The packing volume of the sample can be calculated as:

$$\text{Packing Volume } (\%) = \frac{Ws}{\rho sample} \times \frac{1}{A \times 1} \times 100\%$$

wherein $\rho_{sample}$ is the density of the sample. This density can be measured in accordance with ASTM D-5965, Method B, using a helium pycnometer

DETAILED DESCRIPTION OF THE INVENTION

An essential element of the process of the present invention is the presence of a conductive component in the first powder coating layer that is applied to a substrate. A conductive component is a component that has a resistivity of below 5 Ωcm at a packing volume of ≤70%. The resistivity and packing volume can be measured and calculated as indicated above. In one embodiment the conductive component has a resistivity of below 1 Ωcm at a packing volume of ≤70%.

In one embodiment of the process according to the present invention, the conductive component is a conductive pigment.

Examples of conductive pigments that are suitable for use in the process of the present invention include Black Pearls (carbon black additives for rubber), KetjenBlack EC-600JD and Regal 600.

Examples of pigments that are frequently used in powder coatings, but not suitable for use in the process of the present invention include Sagem Zinc, MZ3043 Zinc and MZ1279 Zinc. These pigments show a resistivity of above 5 Ωcm at a packing volume of ≤70%.

In one embodiment of the process according to the present invention the first powder coating layer comprises 1 to 10 weight % of the conductive component. The weight % being based on the total weight of the powder coating composition.

It was found that when the conductive component is present at a level below 1 weight %, failures occur when the first and second powder coating layer are cured, for example surface defects can be found on the surface of the second cured powder coating layer. If the level of the conductive component is above 10 weight %, the mechanical properties of the cured powder coating layers is not sufficient to provide durability and good mechanical strength to the coating system. It was also found that at higher levels of the conductive component the flow properties of the powder coating are affected, leading to a poor flow of the powder coating.

In a further embodiment, the first powder coating layer comprises 1 to 7 weight % of the conductive component. In yet another embodiment, the first powder coating layer comprises 1 to 5 weight % of the conductive component.

It was found that the process according to the present invention can be used to produce, in a reliable and consistent way, coated substrates without any surface defects and/or flaws in aesthetic appearance and with comparable performance characteristics to an equivalent two layered system prepared with an intermediate curing step. The first and the second powder coating layer can be applied by any powder coating application technique known to the skilled person. Of practical use are in particular the use of a corona charging system or a tribo charging system for the application of the powder coating layers.

Corona Charging System

In a corona charging system a high voltage generator is used to charge an electrode at the tip of the powder coating spray gun which creates an electrostatic field or ion cloud (corona) between the gun and the workpiece/substrate. The powder coating spray gun used in this type of process is called a Corona Gun. Compressed air is used to transport the powder through the gun, and also through the ion cloud. The powder particles pick up charge as they move through the cloud, and through a combination of pneumatic and electrostatic forces, travel towards and deposit upon the earthed target substrate. Most manufacturers of corona spray equipment utilize a negative corona voltage to impart a negative charge to the powder particles. It is possible, however, to use a positive corona voltage to apply a positive charge to a powder particle and such corona charging techniques fall within the scope of this invention.

In one embodiment, the corona spray gun is charged between 30 and 100 kV when the powder coating is applied.

In a further, embodiment the corona spray gun is charged between 70 and 100 kV when the powder coating is applied.

In a further embodiment, the powder throughput using the corona application system is between 100 and 300 g/min.

In a further embodiment, the powder throughput using the corona application system is between 150 and 250 g/min.

Tribo Charging System

In a tribo charging system use is made of the phenomenon that when two different insulating materials are rubbed together and then separated, they acquire opposite charges (+ and −). This method of generating charge via friction is one of the earliest phenomena associated with the electrical properties of materials. Instead of an electrode, tribo guns for the application of a powder coating rely on this friction charging to impart an electrostatic charge onto the powder particles. Compressed air is used to transport the powder particles through the gun. As they travel, the particles strike the walls of the gun, picking up a charge. The pneumatic force of the compressed air then carries the charged particles to the earthed substrate. It is known in the art that a positive charge can be applied to the powder particles by using a tribo gun made of a negative tribo material such as PTFE or similar material and that a negative charge can be applied to the particles by using a gun made of a positive tribo material such as nylon.

In one embodiment, the powder throughput using the tribo charging application system is between 50 and 300 g/min.

In another embodiment, the powder throughput using the tribo charging application system is between 150 and 250 g/min.

Coating Formulation

The function of coatings is to provide protection and/or an aesthetic appearance to a substrate. The film-forming resin and other ingredients are selected so as to provide the desired performance and appearance characteristics. In relation to performance, coatings should generally be durable and exhibit good weatherability, stain or dirt resistance, chemical or solvent resistance and/or corrosion resistance, as well as good mechanical properties, e.g. hardness, flexibility or resistance to mechanical impact; the precise characteristics required will depend on the intended use. The final composition must, of course, be capable of forming a coherent film on the substrate, and good flow and leveling of the final composition on the substrate are required. Accordingly, within a film-forming base, in addition to film-forming binder resin and optional crosslinker, pigment and/or filler there are generally one or more performance additives such as, for example, a flow-promoting agent, a wax, a plasticiser, a stabiliser, for example a stabiliser against UV degradation, or an anti-gassing agent, such as benzoin, an anti-settling agent, a surface-active agent, a UV-absorber, an optical whitener, a radical scavenger, a thickener, an anti-oxidant, a fungicide, a biocide, and/or an effect material, such as a material for gloss reduction, gloss enhancement, toughness, texture, sparkle and structure and the like. The following ranges should be mentioned for the total of the performance additive content of a film-forming polymeric material: 0% to 7% (preferably 0 to 5%) by weight, 0% to 3% by weight, and 1% to 2% by weight.

If performance additives are used, they are generally applied in a total amount of at most 5 wt. %, preferably at most 3 wt. %, more specifically at most 2 wt. %, calculated on the final composition. If they are applied, they are generally applied in an amount of at least 0.1 wt. %, more specifically at least 1 wt. %, calculated on the final composition As with pigments, these standard additives can be included during or after dispersing the binder components, but for optimum distribution it is preferred that they are mixed with the binder components before both are dispersed.

The film-forming polymer used in the manufacture of a film-forming component of a thermosetting powder coating material according to the invention may, for example, be one or more selected from carboxy-functional polyester resins, hydroxy-functional polyester resins, epoxy resins, functional acrylic resins and fluoropolymers.

Suitable thermally curable cross-linking systems for application as a coating composition are for example acid/epoxy, acid anhydride/epoxy, epoxy/amino resin, polyphenol/epoxy, phenol formaldehyde/epoxy, epoxy/amine, epoxy/amide, isocyanate/hydroxy, carboxy/hydroxyalkylamide, or hydroxylepoxy cross-linking systems. Suitable examples of these chemistries applied as powder coatings compositions are described in T. A. Misev, Powder Coatings Chemistry and Technology, John Wiley & Sons Ltd., 1991.

A film-forming component of the powder coating material can, for example, be based on a solid polymeric binder system comprising a carboxy-functional polyester film-forming resin used with a polyepoxide curing agent. Such carboxy-functional polyester systems are currently the most widely used powder coatings materials. The polyester generally has an acid value in the range 10-100, a number average molecular weight Mn of 1,500 to 10,000 and a glass transition temperature Tg of from 30° C. to 85° C., preferably at least 40° C. Examples of commercial carboxy-functional polyesters are: Uralac (Registered trademark) P3560 (DSM Resins) and Crylcoat (Registered trademark) 314 or (UCB Chemicals). The poly-epoxide can, for example, be a low molecular weight epoxy compound such as triglycidyl isocyanurate (TGIC), a compound such as diglycidyl terephthalate condensed glycidyl ether of bisphenol A or a light-stable epoxy resin. Examples of Bisphenol-A epoxy resins are Epikote (Registered trademark) 1055 (Shell) and Araldite (Registered trademark) GT 7004 (Ciba Chemicals). A carboxy-functional polyester film-forming resin can alternatively be used with a bis(beta-hydroxyalkylamide) curing agent such as tetrakis(2-hydroxyethyl) adipamide (Primid (Registered trademark) XL-552).

It was found that in the process according to the present invention any type of powder coating composition can be used for the first powder coating layer and the second powder coating layer, provided that the first powder coating layer and/or the second powder coating layer comprises a conductive component. In one embodiment, only the first powder coating layer comprises a conductive component (and the second powder coating layer does not comprise a conductive component). In another embodiment, the second powder coating layer comprises a conductive component. In a further embodiment, the second powder coating layer comprises a conductive component and an aluminium pigment.

The film forming component in the first powder coating layer can be the same as in the second powder coating layer, but they can also be different.

In one embodiment, the first powder coating layer and the second powder coating layer are applied at a temperature below 50° C. and no heating is applied to the substrate or the first powder coating layer prior to the application of the second powder coating layer.

In a further embodiment, the first powder coating layer and the second powder coating layer are applied at ambient temperature and no heating is applied to the substrate or the first powder coating layer prior to the application of the second powder coating layer.

A powder coating composition comprising a conductive component can be prepared in various ways. The compositions can be prepared by mixing all ingredients, e.g. in an extruder, at a temperature above the softening temperature of the resin but below the curing temperature. The composition is then extruded and cooled to solidify it and is subsequently pulverized.

It is also possible to mix the ingredients, excluding the conductive component, in an extruder at a temperature above the softening temperature of the resin but below the curing temperature. The composition is then extruded and cooled to solidify it and is subsequently pulverized. The conductive component is then mixed with the thus obtained composition.

The invention will be elucidated with reference to the following examples. These are intended to illustrate the invention but are not to be construed as limiting in any manner the scope thereof.

EXAMPLES

The powder coating compositions of Table 1 were prepared by mixing all ingredients in an extruder at a temperature above the softening temperature of the resin but below the curing temperature. The compositions were then extruded and cooled to solidify and then subsequently pulverized.

TABLE 1

| | Type | Color |
|---|---|---|
| PC1 | polyester/epoxy hybrid primer, free of any conductive component | black |
| PC2 | polyester/epoxy hybrid primer, containing 0.3 wt. % of ketjenblack | black |
| PC3 | polyester/epoxy hybrid primer, containing 0.6 wt. % of ketjenblack | black |
| PC4 | polyester/epoxy hybrid primer, containing 1.5 wt. % of ketjenblack | black |
| PC5 | polyester/epoxy hybrid primer, containing 3.0 wt. % of Black Beads 800 | black |
| PC6 | Polyester/Primid powder coating composition, free of any conductive component | white |

Various combinations of a black coating as a primer (first layer) in combination with a white coating (PC6) as topcoat (second layer) were applied to aluminium panels in a dry-on-dry process using a corona charging system. After the application thereof, the primer layer was not heated or cured, only after application of the topcoat was the whole coated substrate was stoved at 180° C. for 15 minutes to get a full cure of both coating layers.

The coated panels were then analysed using a standard scanner. An image was produced of the coated side of the panel. This image was converted into a binary image, and the fraction of pixels in the image that are white were measured.

When there is a full coverage of the (black) primer layer by the (white) topcoat, the fraction of white pixels is 100%. Any lower value for this fraction indicate that there is no full coverage by the topcoat.

The results of the various measurements are listed in Table 2.

TABLE 2

| Primer | Topcoat | Fraction white | Type and amount of conductive component in primer |
|---|---|---|---|
| PC1 | PC4 | 75% | —* |
| PC2 | PC4 | 80% | 0.3 wt. % of ketjenblack* |
| PC3 | PC4 | 83% | 0.6 wt. % of ketjenblack* |
| PC5 | PC4 | 100% | 1.5 wt. % of ketjenblack |
| PC6 | PC4 | 100% | 3.0 wt. % of Black Beads 800 |

*Comparative example

The invention claimed is:

1. A method for the application of at least two different thermosetting powder coating layers to a substrate comprising application of a first powder coating layer followed by the application of a second powder coating layer, without any substantial curing of the first powder coating layer prior to the application of the second powder coating layer, followed by the simultaneous curing of the first powder coating layer and the second powder coating layer, wherein the first powder coating layer comprises 1 to 10 weight % of a conductive component, the conductive component having a resistivity of below 5 Ωcm at a packing volume of ≤70% and the weight % being calculated based upon the total composition of the first powder coating layer.

2. The method of claim 1 wherein the first powder coating layer comprises 1 to 7 weight % of the conductive component.

3. The method of claim 1 wherein the first powder coating layer comprises 1 to 5 weight % of the conductive component.

4. The method of claim 1 wherein the first powder coating layer and the second powder coating layer are applied by using a corona charging system.

5. The method of claim 4 wherein the corona charging system is charged to a potential of between 70 and 100 kV.

6. The method according to claim 5 wherein the first or the second powder coating layer is applied at an application rate between 100 and 300 g/min.

7. The method according to claim 4 wherein the first powder coating layer and the second powder coating layer are applied at a temperature below 50° C. and no heating is applied to the substrate or the first powder coating layer prior to the application of the second powder coating layer.

8. The method of claim 7 wherein the first powder coating layer and the second powder coating layer are applied at ambient temperature.

9. The method according to claim 4 wherein the first or the second powder coating layer is applied at an application rate between 100 and 300 g/min.

10. The method according to claim 1 wherein the first powder coating layer and the second powder coating layer are applied at a temperature below 50° C. and no heating is applied to the substrate or the first powder coating layer prior to the application of the second powder coating layer.

11. The method of claim 10 wherein the first powder coating layer and the second powder coating layer are applied at ambient temperature.

12. A method for the application of at least two different thermosetting powder coating layers to a substrate comprising the steps of application of a first powder coating layer followed by the application of a second powder coating layer, without any substantial curing of the first powder coating layer prior to the application of the second powder coating layer, followed by the simultaneous curing of the first powder coating layer and the second powder coating layer, wherein the second powder coating layer comprises 1 to 10 weight % of a conductive component having a resistivity of below 5 Ωcm at a packing volume of ≤70%, wherein the weight % is calculated based upon the total composition of the second powder coating layer.

13. The method of claim 12 wherein the second powder coating layer comprises 1 to 7 weight % of the conductive component.

14. The method of claim 12 wherein the second powder coating layer comprises 1 to 5 weight % of the conductive component.

15. The method of claim 12 wherein the first powder coating layer and the second powder coating layer are applied by using a corona charging system.

16. The method of claim 15 wherein the corona charging system is charged to a potential of between 70 and 100 kV.

17. The method according to claim 15 wherein the first or the second powder coating layer is applied at an application rate between 100 and 300 g/min.

18. The method according to claim 16 wherein the first or the second powder coating layer is applied at an application rate between 100 and 300 g/min.

19. The method according to claim 12 wherein the first powder coating layer and the second powder coating layer are applied at a temperature below 50° C. and no heating is applied to the substrate or the first powder coating layer prior to the application of the second powder coating layer.

20. The method of claim 19 wherein the first powder coating layer and the second powder coating layer are applied at ambient temperature.

* * * * *